United States Patent [19]

Weast

[11] 4,026,055

[45] May 31, 1977

[54] TELESCOPIC SIGHT MOUNTING

[76] Inventor: Gerald T. Weast, 23702 Crossley, Hazel Park, Mich. 48050

[22] Filed: Apr. 9, 1976

[21] Appl. No.: 675,289

[52] U.S. Cl. ..... 42/1 ST; 33/245

[51] Int. Cl.[2] ..... F41G 1/38

[58] Field of Search ..... 42/1 ST; 33/250, 245, 33/247

[56] References Cited

UNITED STATES PATENTS

| | | | |
|---|---|---|---|
| 2,580,246 | 12/1951 | Schall | 33/250 |
| 2,803,907 | 8/1957 | Weaver | 42/1 ST |
| 3,253,361 | 5/1966 | Kingsbury | 42/1 ST |
| 3,835,565 | 9/1974 | Weast | 42/1 ST |
| 3,875,675 | 4/1975 | Krisay | 42/1 ST |

*Primary Examiner*—Charles T. Jordan

*Attorney, Agent, or Firm*—Charles W. Chandler

[57] ABSTRACT

A dual sight mounting for supporting a telescopic sight on a firearm having iron sights. Several embodiments are illustrated, each mounting comprising a pair of laterally spaced mounting members, each member having an upper wall which cooperates with a similarly formed upper wall on the other member to engage the telescopic sight between them. A fastener mounted on the mid-section of the two members is operative to clamp the sight between their upper walls as the firearm is clamped between the lower halves of the two mounting members. The telescopic sight is supported to form an opening between the barrel and the telescopic sight permitting the user to view the iron sights along a line of sight passing between the lower halves of the two mounting members.

9 Claims, 8 Drawing Figures

Fig-5
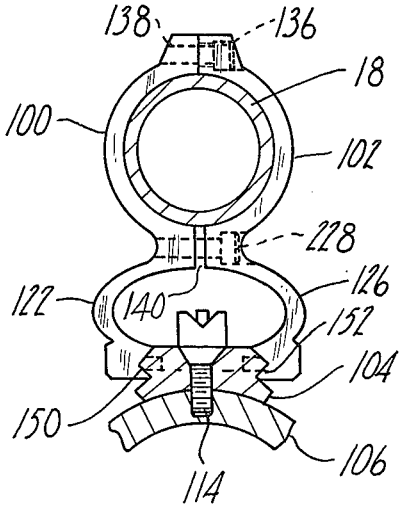
Fig-6
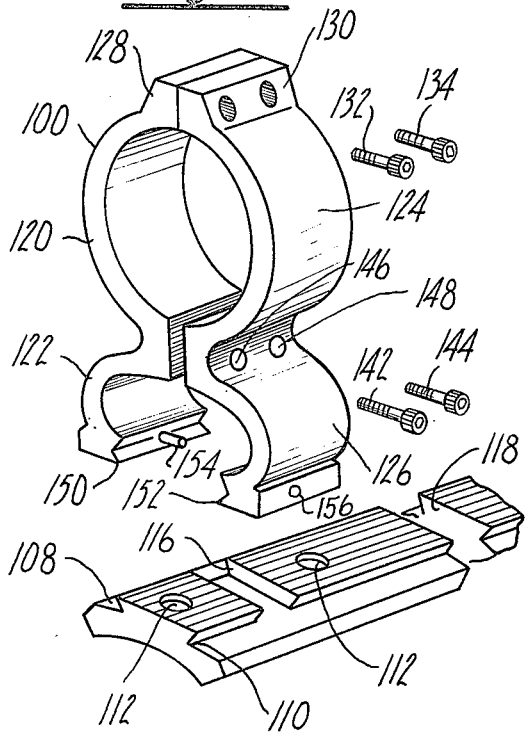
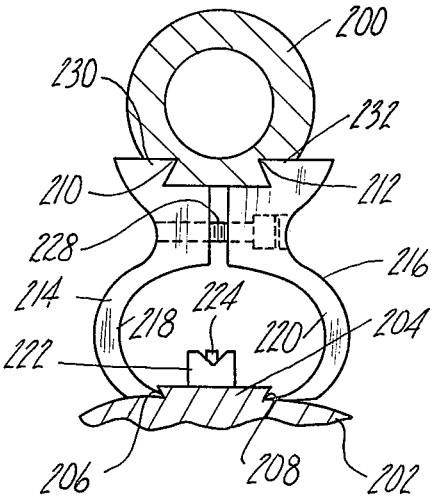
Fig-7
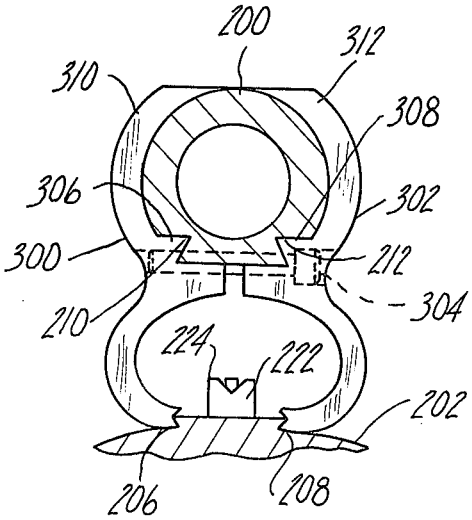
Fig-8

TELESCOPIC SIGHT MOUNTING

BACKGROUND OF THE INVENTION

This invention is related to telescopic sight mountings and more particularly to an improved mounting of the type that permits the firearm user to use either a telescopic sight or the firearm's iron sights.

Some commercial mountings for telescopic sights support the sight in a raised position above the firearm barrel so that the user can view either the iron sight mounted on the barrel or the telescopic sight. An improved form of such a sight was disclosed in my U.S. Pat. No. 3,835,565 which issued Sept. 17, 1974 in which a pair of spaced lower walls of the mounting member are clamped on opposite sides of a base plate attached to the firearm. Such an arrangement reduced the conventional mounting structure between the telescopic sight and the barrel that might interfere with the line of sight of the user when employing the iron sights.

SUMMARY OF THE INVENTION

The broad purpose of the present invention is to provide a dual sight mounting in which the telescopic sight is clamped between the upper half of a pair of laterally separable mounting members, and the firearm is clamped between the lower edges of the two mounting members. The two mounting members are formed from a pair of identically shaped elements that are then drilled and tapped to receive a pair of threaded fasteners. Such a dual sight mounting not only employs fewer fasteners than conventional commercial dual sight mountings, but is easier to mount on the firearm barrel, provides a much more attractive mounting, and reduces manufacturing costs.

Still further objects and advantages of the present invention will become readily apparent to those skilled in the art to which it pertains upon reference to the following detailed description.

DESCRIPTION OF THE DRAWINGS

The description refers to the accompanying drawings in which like reference characters refer to like parts throughout the several views, and in which:

FIG. 5 is an end view of another embodiment of the invention;

FIG. 6 is an exploded view of the embodiment of FIG. 5;

FIG. 7 is the end view of still another embodiment of the invention; and

FIG. 8 is an end view of still another embodiment of the invention.

DESCRIPTION OF THE PREFERRED EMBODIMENT

Figure 1:
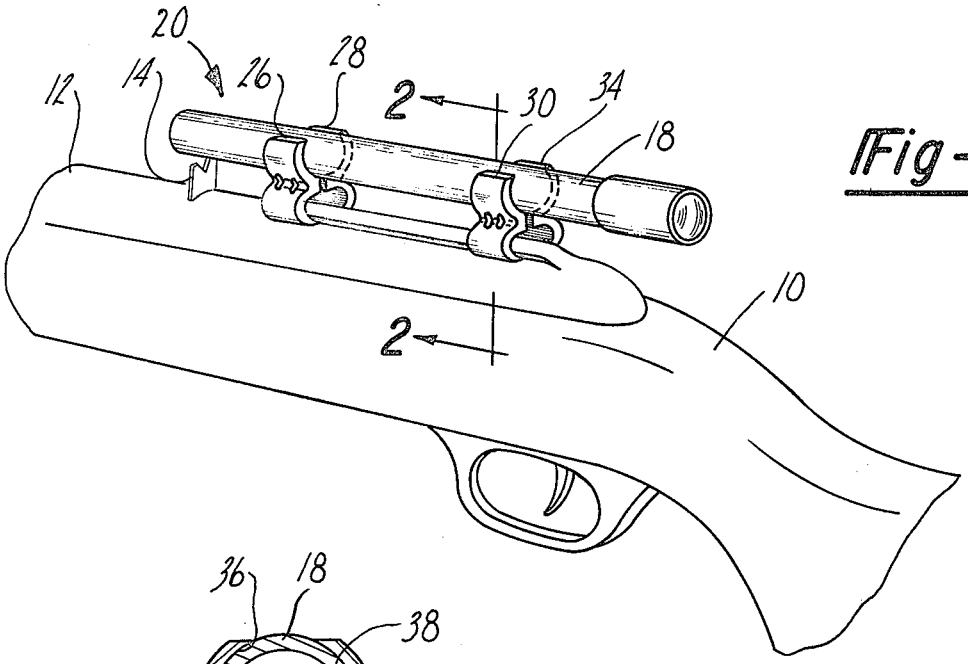
FIG. 1 is a perspective view of a rifle having a telescopic sight supported by a dual sight mounting illustrating the preferred embodiment of the present invention.
Figure 2:
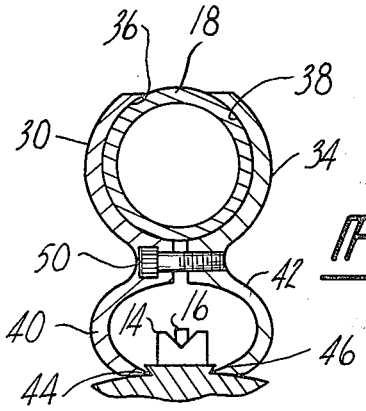
FIG. 2 is a view as seen along line 2—2 of FIG. 1.

Referring to the drawings, FIGS. 1 and 2 illustrate a conventional rifle 10 having an elongated barrel 12. Iron sights 14 and 16 are mounted along barrel 12 in the manner well known to those skilled in the art. A conventional telescopic sight 18 is supported by mounting means 20 on the receiver portion of barrel 12 such that sight 18 is spaced above the receiver and parallel to the barrel.

Mounting means 20 includes a pair of cooperating mounting members 26 and 28 mounted near one end of scope 18, and a second pair of cooperating mounting members 30 and 34 mounted near the opposite end of scope 18. Mounting members 30 and 34 are identical with respect to mounting members 26 and 28 and cooperate in the same manner to support the telescopic sight except with respect to their locations along barrel 12.

Figure 3:
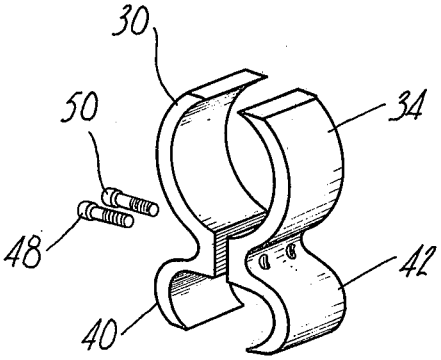
FIG. 3 is an exploded view of one of the pair of sight mountings.

Referring to FIGS. 2 and 3, mounting member 30 has an upper wall with a substantially semi-cylindrical surface 36 receiving one lateral side of sight 18. Mounting member 34 has a substantially cylindrical surface 38 engaging the opposite side of sight 18 in an opposed relationship with respect to surface 36. It is to be noted that the upper edge of mounting member 30 is spaced from the upper edge of mounting member 34 so that sight 18 is clamped between the upper halves of the two mounting members.

Mounting member 30 has a lower half forming a curved wall 40 spaced from a similarly shaped curved wall 42 on the lower half of mounting member 34. Walls 40 and 42 are so spaced as to form an opening between them for viewing iron sights 14 and 16 as can be seen in FIG. 2. The lower edge of mounting member 30 is received in a substantially V-shaped groove 44 along the upper side of barrel 12. The lower edge of mounting member 34 is received in a V-shaped groove 46 that is spaced from and parallel to groove 44. The two V-shaped grooves 44 and 46 are elongated so that mounting members 30 and 34 can be slidably adjusted along the barrel to a selected position.

A pair of threaded fasteners 48 and 50 are mounted on the mid-section of mounting member 30 and threadably connected to the mid-section of mounting member 34 so as to be operative to move mounting member 34 toward mounting member 30 when sight 18 is being clamped between them. It is to be noted that the mid-section of mounting member 34 is spaced from the mid-section of mounting member 30 and that the upper and lower walls of each of the mounting members is resilient. Thus as the user manipulates fasteners 48 and 50 to move one mounting member toward the other, the two mounting members cooperate to clamp sight 18 between their upper halves and to clamp the base plate between their lower edges. This arrangement simplifies the mounting procedure because of the reduced number of fastening members. In addition, the arrangement also provides a much more streamlined appearance with respect to commercially available mountings.

Figure 4:
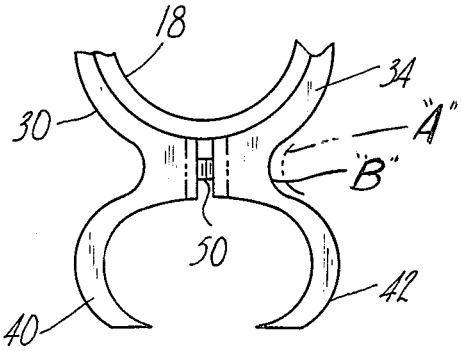
FIG. 4 is an enlarged view of the mid-section of the preferred mount.

Referring to FIG. 4, both mounting members 30 and 34 are preferably formed of aluminum in a resilient construction such that as the mid-section of mounting member 34 is drawn from the position illustrated in phantom at "A" toward the mid-section of mounting member 30 and its position illustrated in solid lines at "B", the telescopic sight is clamped between the upper half of the two mounting members and the mounting grooves 44 and 46 are clamped between the lower halves of the two mounting members. Thus only two screws are required to mount sight 18 on the barrel 12 as opposed to at least four on most commercially-available sight mountings. In the embodiment of the invention illustrated in FIGS. 1–4, the two mounting members are spaced from one another and both at their upper ends, their lower ends, as well as their mid-sections. This allows the user to apply whatever necessary clamping force is necessary to tighten threaded fasteners 48 and 50 to take advantage of the resilient nature of the walls of the two mounting members.

Referring to FIGS. 5 and 6, a second embodiment of the invention comprises a pair of mounting members 100 and 102. This embodiment is mounted on a base plate 104 that is attached to barrel 106 of a conventional firearm. Base plate 104 is also conventional and comprises an elongated metal base member having parallel V-shaped grooves 108 and 110 running the full length of the base member. Base plate 104 has openings 112 for receiving threaded fasteners 114 (only one shown) for attaching the base plate to barrel 106. The base plate has a pair of slots 116 and 118 disposed in the upper surface of the base plate transverse to its length.

Mounting member 100 has an upper curved wall 120 adapted to engage one side of telescopic sight 18 and a lower wall 122 which supports the sight a predetermined distance above base plate 104. Similarly, mounting member 102 has an upper wall 124 adapted to receive the opposite side of sight 18 and a lower wall 126 which is curved in a manner similar to wall 122. Mounting members 100 and 102 are both formed of a resilient material.

Upper wall 120 terminates in a flange 128, and upper wall 124 terminates in a flange 130. The two flanges are joined together by a pair of threaded fasteners 132 and 134. As illustrated in FIG. 5, each of the threaded fasteners 132 and 134 has a head seated in an opening 136 such that its opposite end is threadably engaged with a threaded opening 138. When the walls 120 and 124 are engaged on opposite sides of sight 18, the flanges 128 and 130 are disposed in contact one with the other by threaded fasteners 132 and 134. In this position, a slight gap or opening 140 is formed between the mid-sections of mounting members 100 and 102 as illustrated in FIG. 5.

A pair of threaded fasteners 142 and 144 are received in openings 146 and 148 so as to be operative to move the lower walls 122 and 126 toward one another so that lower lips 150 and 152 are received in grooves 108 and 110 respectively.

Referring to FIG. 6, a pin 154 is carried adjacent the lower edge of wall 122 and a similar pin 156 is carried adjacent the lower edge of wall 126. The two pins are aligned with one another so as to be received in slot 116 to precisely locate the two mounting members on the base plate.

FIG. 7 illustrates still another embodiment of the invention used for mounting a sight 200 on a firearm barrel 202 having a raised portion 204 with parallel grooves 206 and 208 in a manner similar to firearm barrel 12 illustrated in FIG. 1. This embodiment of the invention is useful for a sight having longitudinal grooves 210 and 212 along the bottom of the sight parallel to its longitudinal axis.

A pair of similarly shaped mounting members 214 and 216 are mounted on barrel 202. Mounting member 214 has a lower wall 218 which cooperates with a lower wall 220 on mounting member 216 to form an opening for iron sights 222 and 224. A pair of threaded fasteners 228 (only one illustrated) is mounted on the mid-section of the two mounting members to draw one toward the other to clamp raised portion 204 between the lower edges of the two mounting members. Mounting member 214 has a lip 230 received in slot 210 and mounting member 216 has a lip 232 received in slot 212 so that the telescopic sight can be clamped between the upper halves of the two mounting members as the firearm barrel is clamped between their lower edges.

FIG. 8 illustrates still another embodiment of the invention similar to the embodiment of FIG. 7 in which a pair of mounting members 300 and 302, of a resilient construction, are mounted on firearm 202 to support a sight 200.

In this embodiment of the invention, the lower edges of mounting members 300 and 302 are received in slots 206 and 208, respectively, as a threaded fastener means 304, mounted on the mid-section of the mounting members is manipulated by the user to move one mounting member toward the other. Mounting member 300 has a lip 306 received in slot 210 of the sight, and mounting member 302 has a lip 308 received in the opposite lip 212 of the sight. The mounting member 300 also has a curved wall 310 which embraces the opposite side of the telescopic sight in such a manner that the sight is clamped between walls 310 and 312 in a manner similar to that of the embodiment of FIG. 1.

It is to be noted that in each of the embodiment of the invention I have disclosed a pair of mounting members that are drawn together by a pair of threaded fasteners supported substantially in the mid-section of the mounting members. The two mounting members are slightly spaced one from the other to take advantage of the resiliency of the two mounting members in clamping the telescopic sight between the upper halves of the mounting members as the firearm barrel is clamped between the lower halves of the two mounting members. In each embodiment, the sight is spaced a sufficient distance away from the firearm barrel to enable the user to employ the irons sights independently of the telescopic sight. In addition, it is to be noted that in each embodiment the two mounting members are formed of a pair of halves which are identical except that one has an opening for receiving the head of a pair of threaded fasteners while the other has a tapped opening for engaging the threaded end of the fasteners. By employing only two components for each mounting device, except for the threaded fasteners, results in a substantial reduction in manufacturing costs, as well as a reduction in the time for mounting the sight and also provides an arrangement having an attractive appearance.

Having described my invention, I claim:

1. In combination with a firearm having an iron sight mounted on an elongated barrel:

a telescopic sight;

base means mounted on the firearm and having a pair of spaced grooves disposed parallel to the firearm barrel;

a unitary first mounting member having an upper wall, a lower wall, and a midsection integrally connected to said walls;

a unitary second mounting member having an upper wall, a lower wall, and a midsection integrally connected to said walls;

the lower wall of the first mounting member and the lower wall of the second mounting member being engageable in the grooves of the base means in a position in which the upper walls of the first mounting member and the second mounting member cooperate in a spaced relationship to support the telescopic sight in a supported position between said upper walls substantially parallel to the firearm barrel;

fastener means connecting the midsection of the first mounting member to the midsection of the second mounting member so as to be operative to move the upper wall of the first mounting member toward the upper wall of the second mounting member to engage opposite sides of the telescopic sight in said supported position as the lower wall of the first mounting member is being moved toward the lower wall of the second mounting member to clampingly engage the grooves of the base means between the lower edges of said lower walls, whereby when the sight is in said supported position, the fastener means are disposed between the telescopic sight and the base means, and the lower wall of the first mounting member and the lower wall of the second mounting member define an opening permitting the user to view the iron sight along a line of sight between the base means and the fastener means.

2. A combination as defined in claim 1, in which the opposite side edges of the base means have V-shaped grooves parallel to the longitudinal axis of the firearm barrel and the lower edges of the first mounting member and the second mounting member are engaged in said V-shaped grooves.

3. A combination as defined in claim 1, in which the first mounting member and the second mounting member are slidably adjustable along the grooves of the base means.

4. A combination as defined in claim 1, including a second pair of mounting members mounted on the base means and longitudinally spaced therealong with respect to the first pair of mounting members so as to cooperate with said first mentioned pair of mounting members in supporting the telescopic sight on the firearm.

5. A combination as defined in claim 1, in which the fastener means are adapted to removably clamp the base means between the lower edges of said first mounting member and said second mounting member.

6. A combination as defined in claim 1, in which the upper wall of said first mounting member has a substantially semi-cylindrical surface for receiving the telescopic sight and the upper wall of the second mounting member has a substantially semi-cylindrical surface for receiving the telescopic sight in an opposed relationship with respect to the semi-cylindrical wall of the first mounting member.

7. A combination as defined in claim 1, in which the base means includes a groove disposed transverse to the length of the firearm barrel and including pin means carried by at least one of the mounting members, said pin means being received in the transverse groove to prevent longitudinal motion of the mounting member with respect to the firearm barrel.

8. In combination with a firearm having an iron sight mounted on an elongated barrel, a telescopic sight having a pair of spaced, parallel grooves, base means mounted on a firearm, and having a pair of spaced, parallel grooves disposed parallel to the firearm barrel, a first mounting member, and a second mounting member spaced with respect to the first mounting member and means carried by said mounting members received in the grooves of said telescopic sight to support the sight in a position substantially parallel to the longitudinal axis of the firearm barrel, said first mounting member and said second mounting member each having a lower wall disposed in the parallel grooves of the base means, and fastener means engaging the first mounting member and the second mounting member so as to be operative to move the first mounting member toward the second mounting member to engage the grooves of the telescopic sight as the first and the second mounting members are being moved toward one another to engage the grooves of the base means, the fastener means being disposed between the telescopic sight and the base means and being so spaced from the base means as to form an opening between the lower walls of the first and the second mounting members permitting the user to view the iron sight along a line sight between the base means and the telescopic sight.

9. A method for mounting a telescopic sight on a firearm having means forming a pair of spaced grooves parallel to an elongated barrel comprising the steps of:

forming a pair of identically shaped one-piece sides, each side having an upper wall and a lower wall on opposite sides of a midsection, the upper wall of each side being shaped to engage a portion of a telescopic sight, and the lower wall of each side having a lower edge receivable in the grooves of the firearm, mounting a fastener member on the midsections of said pair of sides such that the fastener member is operative to move one of the sides toward the other side to engage the telescopic sight in a supported position between said upper walls as said spaced grooves are being clamped between the lower edges of the lower walls whereby the upper edge of the upper wall of the first mounting member is spaced from the upper edge of the upper wall of the second mounting member, and the midsection of the first mounting member is spaced from the midsection of the second mounting member at such times as the telescopic sight is disposed in said supported position.

* * * * *